US006322630B1

(12) United States Patent
Carroll et al.

(10) Patent No.: US 6,322,630 B1
(45) Date of Patent: Nov. 27, 2001

(54) RETRACTABLE COATING DISPENSER AND METHOD

(75) Inventors: Kenneth P. Carroll, Fayetteville; David Cushing, Suwanee; Greg Evans, Buford, all of GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/183,353

(22) Filed: Oct. 30, 1998

(51) Int. Cl.[7] ..... B05C 11/00

(52) U.S. Cl. ..... 118/681; 118/125; 118/405; 118/DIG. 18

(58) Field of Search ..... 118/DIG. 18, 675, 118/405, 410, 420, 684, 681, 679, 404, 234, 208, 676, 688, 125; 427/117, 118, 120, 501, 209; 425/113, 136

(56) References Cited

U.S. PATENT DOCUMENTS

| | | | | |
|---|---|---|---|---|
| 3,247,547 | * | 4/1966 | Smith | 118/125 |
| 4,263,348 | * | 4/1981 | Renegar . | |
| 4,419,958 | * | 12/1983 | Roba . | |
| 4,688,515 | * | 8/1987 | Rosebrooks | 118/405 |
| 5,114,633 | | 5/1992 | Stewart | 264/23 |
| 5,306,867 | | 4/1994 | Connole et al. | 174/23 R |
| 5,310,582 | | 5/1994 | Vyakarnam et al. | 427/560 |
| 5,429,840 | * | 7/1995 | Raterman et al. | 427/256 |
| 5,449,408 | * | 9/1995 | Koaizawa et al. . | |
| 5,607,531 | | 3/1997 | Needham et al. | 156/166 |
| 5,656,090 | * | 8/1997 | Preston et al. . | |
| 5,788,772 | * | 8/1998 | Kunieda et al. | 118/264 |
| 5,843,231 | * | 12/1998 | Spencer et al. | 118/420 |
| 5,882,407 | * | 3/1999 | Takeno et al. | 118/419 |

OTHER PUBLICATIONS

Nordson Corporation, *Fiber Optic Cable Sealing*, Application Bulletin, Oct. 1988.

* cited by examiner

*Primary Examiner*—Brenda A. Lamb
(74) *Attorney, Agent, or Firm*—Wood, Herron & Evans, L.L.P.

(57) ABSTRACT

An apparatus and method for applying a coating to an elongated substrate such as a wire or cable. The coating apparatus has an opposed pair of mouthpieces each connected respectively to a pair of dispensers which are in fluid communication with a source of heated liquid such as a hot melt coating material. The mouthpieces have complimentary recesses which form a throughhole when placed in a closed position such that a wire or cable passing through the throughhole may be coated with the liquid. The dispensers are operatively connected to actuators which move the modules in opposing directions to closed and open positions.

10 Claims, 6 Drawing Sheets

RETRACTABLE COATING DISPENSER AND METHOD

FIELD OF THE INVENTION

The present invention generally relates to apparatus and methods for coating elongated substrates and, more specifically, for coating substrates such as fiber optic cable, metallic cable, wire, cords, filaments, and strength members.

BACKGROUND OF THE INVENTION

During the manufacture of elongated substrates, such as wires or cables, it is common to coat the wire or cable with an exterior thermoplastic coating. These exterior coatings can serve several purposes such as thermal and electrical insulation, corrosion protection and water blocking. The quality of the wire or cable is heavily dependent upon the quality of the exterior coating. If the coating is of inferior quality, uniformity or integrity, the performance of the wire or cable may be severely diminished. The characteristics of the coating are affected by both the coating material itself and the coating apparatus.

In more basic coating techniques, a continuous length of wire or cable simply passes through a heated slurry bath of coating material. As the wire or cable pass through the bath, the coating material adheres to the exterior of the wire or cable to provide the desired protective coating. The slurry bath technique, however, may yield marginally acceptable finished coatings, especially for those substrates requiring uniform and homogenous coatings. The slurry bath technique lacks the precise control needed to produce a consistent, high-quality coating on a substrate. The coating material in a bath may also be subject to increased contamination. Additionally, during an interruption in the manufacturing process, the wire or cable may not be easily removed from the heated slurry bath. As a result, temperature sensitive substrates may be damaged when exposed for extended periods to the bath.

In an effort to improve the quality of the coating on wires and cables, for example, coating systems have been designed with one-piece heated dies to apply the thermoplastic coating instead of a slurry bath. In such systems, a wire or cable is threaded and continuously moved through an aperture in the one-piece die. The coating material is then dispensed through the die and around the wire or cable. By employing a dispensing die, the amount or thickness of coating material applied to the substrate can be controlled in a precise manner.

The one-piece die coating technique, however, does have disadvantages. For instance, if the production line stops while the wire or cable is being coated, the wire or cable typically remains within the heated die. For temperature sensitive substrates, such as fiber optic cable, the continuous contact with the heated die may cause damage to the substrate itself. Additionally, one-piece dies do not provide for easy removal of the wire or cable. For instance, to remove the wire or cable from the one-piece die, one end of the wire or cable must pass through and exit the die. Although the wire or cable could be cut at the one-piece die to facilitate easier removal of the substrate from the production line, typical manufacturing techniques require the production of continuous rolls of wire or cable.

For at least these reasons, it would be desirable to provide a coating apparatus that would have the advantages of a one-piece die, but fewer disadvantages thereof. For example, it would be desirable to easily retract the die away from an underlying substrate, such as temperature-sensitive fiber optic cable, during a production interruption. Such a retractable dispenser system would also readily permit installation or removal of the wire or cable during the manufacturing process.

SUMMARY OF INVENTION

The present invention overcomes various shortcomings of previous coating systems and techniques. The present invention is generally directed to an apparatus for coating many forms of elongated substrates, such as wire, metal cable, fiber optic cable, cords, filaments, or strength members. The coating apparatus has first and second dispensers which are preferably ON/OFF dispensing valves, guns or modules, with each dispenser having a liquid passageway adapted to connect to a source of heated liquid, such as a heated thermoplastic liquid. The dispensers may take many other forms suitable for dispensing a controlled amount of liquid. The first and second dispensers are disposed opposite one another and first and second actuators preferably move the dispenser in opposing directions to closed and open positions with respect to the elongated substrate. At least one actuator control device controls the respective actuators. Preferably, the actuators are pneumatic pistons and the actuator control device is a 4-way solenoid valve. One or both dispensers may move along straight or arcuate paths to establish the closed or open position. As one alternative, the first dispenser could remain stationary and an actuator could simply move the second dispenser relative to the first dispenser to reach the open or closed position. However, if the substrate is temperature sensitive, such as fiber optic cable, it is preferred that both dispensers automatically move away from the cable to prevent heat damage to the cable in the event that the coating process stops.

In the preferred embodiment, the apparatus also has first and second mouthpieces connected respectively with the first and second dispensers. The mouthpieces have complimentary recesses such that when the first and second dispensers are in their closed position the recesses form a throughhole, preferably oriented perpendicular to the longitudinal axes of the dispensers, for receiving the elongated substrate. The recesses in the first and second mouthpieces, for example, preferably include arcuate portions for generally conforming to a round wire or cable. Each recess communicates with the liquid passageways in the dispensers such that when the first and second dispensers are in their closed position an elongated substrate passing through the throughhole may be coated with the liquid coming from the liquid source. Generally, a stepped bore is formed in the throughhole with a smaller diameter portion thereof receiving the substrate only and a larger diameter portion receiving the substrate and the coating liquid.

The coating apparatus also includes first and second liquid discharge pieces that are respectively disposed between the first and second dispensers and the first and second mouthpieces. Each liquid discharge piece has a liquid discharge orifice which is in fluid communication with the liquid passageways of the first and second dispensers. Finally, in the preferred embodiment first and second shims are respectively disposed between the first and second liquid discharge pieces and the respective first and second mouthpieces to form a liquid discharge channel which is in fluid communication with the liquid discharge orifice.

As an additional feature, a guide member is adapted to align and support the elongated substrate as it passes through the throughhole during a coating operation. As still another feature, the mouthpieces include alignment members which align the throughhole with the substrate to further assure uniform, concentric coating of the substrate.

The present invention is also directed to methods for coating an elongated substrate, such as a wire or cable, generally involving the use of coating apparatus such as described above. Using the present invention, a continuous coating may be applied to a substrate or, in the alternative, an intermittent or broken coating may be applied to satisfy the needs of the user. Using a sensing device to detect when the substrate stops moving or when the coating process otherwise stops, the actuator control device and actuators cause the dispensers to retract away from the substrate, for example, to prevent heat damage.

The coating apparatus and methods of the present invention have several advantages. For instance, the aligned mouthpieces of the coating apparatus provide a uniform, concentric coating around, for example, wires and cables. Additionally, the dispensers and associated mouthpieces can automatically retract away from the wire or cable for easy installation and removal thereof. The hot mouthpieces disengage the substrate such that a temperature sensitive substrate will not be damaged as may occur with a one-piece die. The coating can be more precisely applied than previous slurry bath systems. Production speed may be increased thereby decreasing the process cost. Finally, because the coating is applied in a controlled fashion, the coating material is not continuously reused and potentially contaminated as with slurry bath techniques.

Various additional advantages and objects of the invention will become more readily apparent to those of ordinary skill in the art upon consideration of the following detailed description of the presently preferred embodiments taken in conjunction with the accompanying drawings.

DETAILED DESCRIPTION OF DRAWINGS

DETAILED DESCRIPTION OF THE PREFERRED EMBODIMENTS

Figure 1:
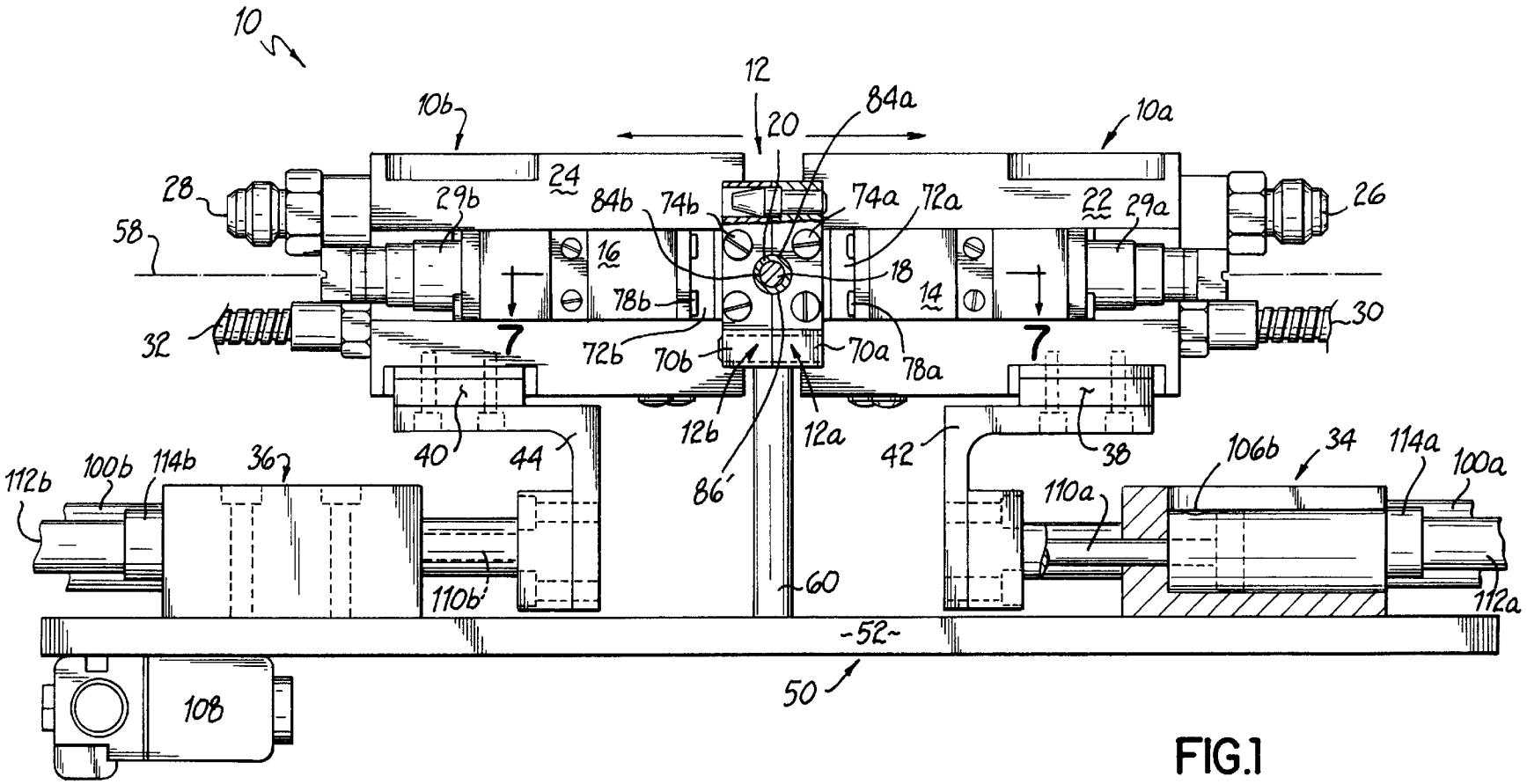
FIG. 1 is an elevational view of a coating apparatus according to one embodiment of the invention.
Figure 2:
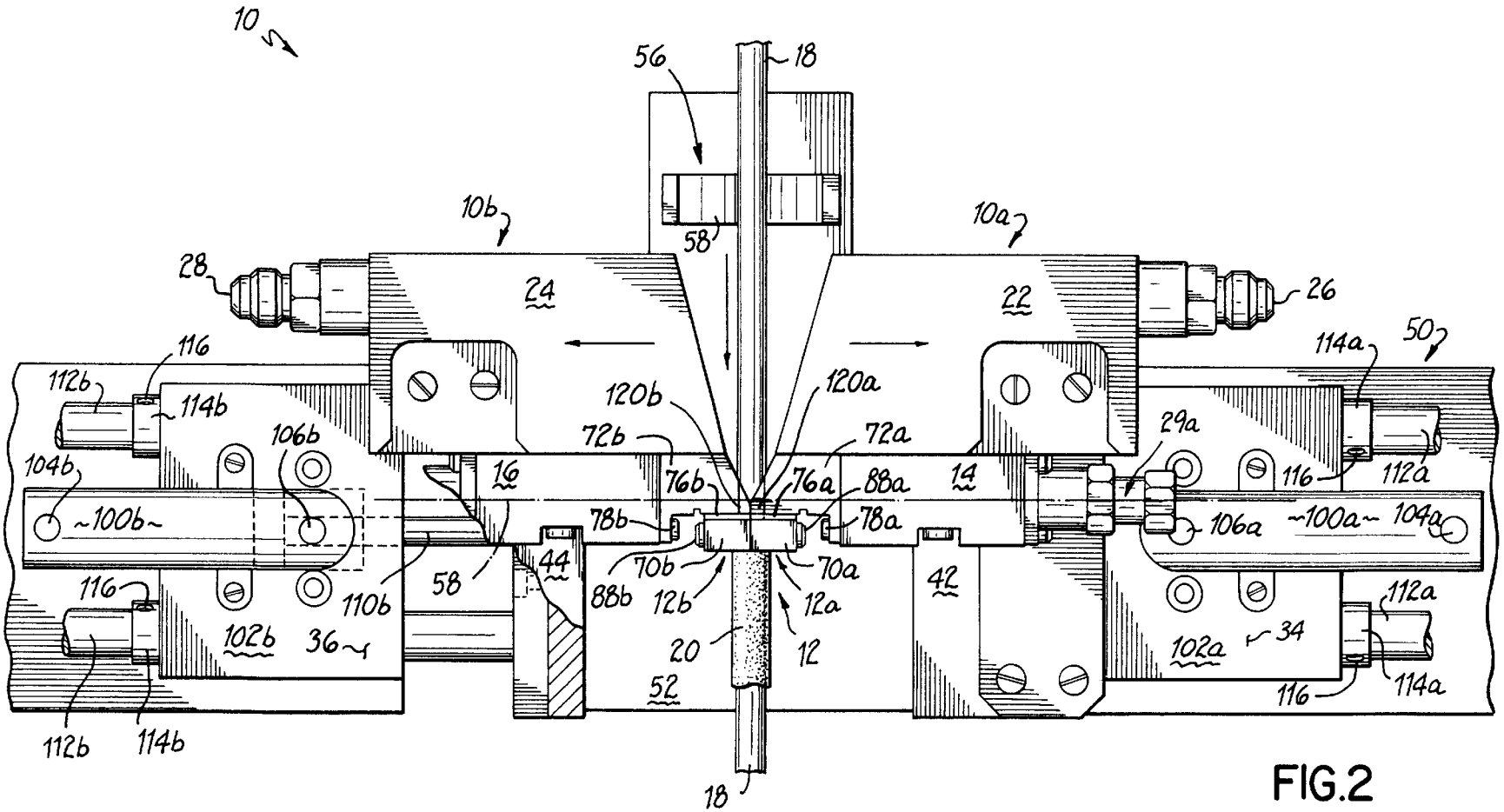
FIG. 2 is a top view of the coating apparatus of FIG. 1.

Referring first to FIGS. 1 and 2, a coating apparatus 10 is shown specifically adapted for dispensing a heated liquid onto an elongated substrate in accordance with the principles of this invention. The substrate may be, for example, a wire, a cable, a cord, a filament, a strength member, etc. While it will be understood that any desired liquid may be dispensed in accordance with the invention, for the sake of simplicity, the present invention will be described more specifically in connection with dispensing heated thermoplastic liquids, such as hot melt coatings. These coatings are typically heated to about 250° F. and above. The inventive principles will be described with reference to only one of many possible embodiments of coating apparatus falling within the scope of this invention.

Coating apparatus 10 includes a retractable coating head 12.

Apparatus 10 includes retractable portions 10*a*, 10*b* and coating head 12 includes corresponding retractable head portions 12*a* and 12*b*. First and second separable head portions 12*a*, 12*b* are respectively connected to first and second dispensers, such as modules or guns 14, 16. Portions 12*a*, 12*b* of coating head 12 cooperate with each other to coat an elongated substrate, such as a fiber optic cable 18, with a liquid 20. In generally known manners, the dispensing modules can serve as on/off dispensers or valves by moving a valve stem with respect to a valve seat disposed in a liquid passage. The valve stem may be pneumatically or electrically actuated to selectively dispense liquid from the outlet of the passage. Commercially available examples of a pneumatically actuated dispensing module 14 or 16 are the H-200 or H-400 modules, both of which are available from Nordson Corporation, Westlake, Ohio.

First and second dispensing modules 14, 16 are connected respectively via fluid passageways to first and second manifolds 22, 24. First and second manifolds 22, 24 are connected to a source of coating liquid (not shown) via first and second liquid inlet ports 26, 28. Manifolds 22, 24 also may be operatively connected to a source of pressurized air for driving the valve stems of dispensing modules 14, 16, if they are pneumatically operated.

Manifolds 22, 24 are connected to a source of electric power through first and second electrical conduits 30, 32. The electric power is used to operate internal heaters which heat the coating liquid 20 prior to its application onto cable 18. It is contemplated that the present invention will use the H-200 Mini-slot manifold which is manufactured and sold by the assignee of the present invention, Nordson Corporation of Westlake, Ohio.

Figure 3:
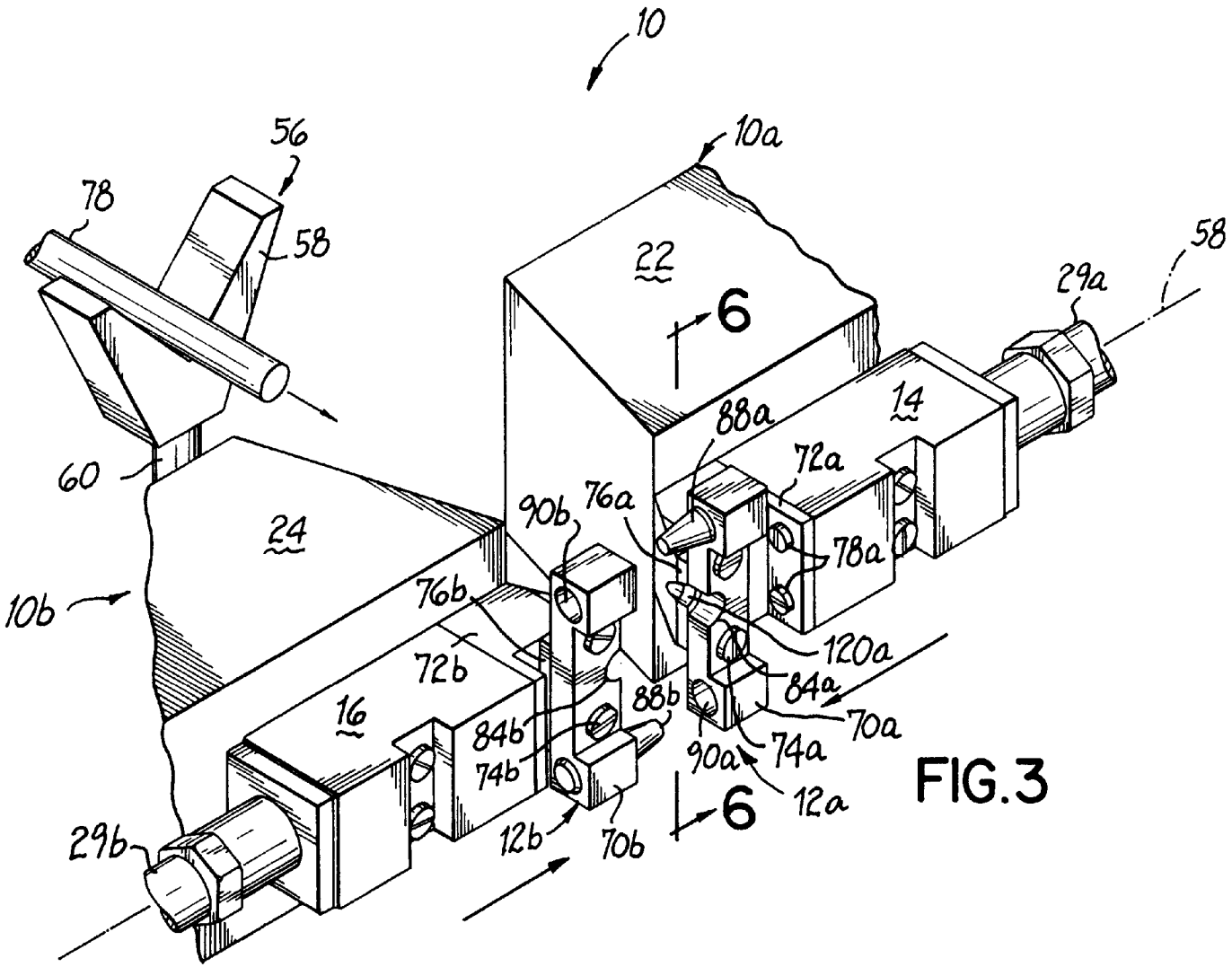
FIG. 3 is a perspective view of the coating apparatus of FIGS. 1 and 2 in an open position.

First and second manifolds 22, 24 are operatively connected to first and second air actuators 34, 36. More specifically, air actuators 34, 36 are connected to first and second manifolds 22, 24 by first and second mounting plates 38, 40 which are connected respectively to first and second connecting members 42, 44. First and second actuators 34, 36 are mounted to a support structure 50. Support structure 50 could be any suitable structure for supporting the actuators as well as any other components of the coating apparatus 10. Advantageously, support structure 50 is a base member 52 which provides support for the entire coating apparatus 10. First actuator 34 moves first manifold 22, first dispensing module 14, and portion 12*a* of coating head 12 as a combined unit. Likewise, second actuator 36 moves second manifold 24, first dispensing module 16, and portion 12*b* of coating head 12 as a combined unit. As illustrated in FIGS. 1 and 2, the actuators 34, 36 have moved the respective portions 10*a*, 10*b* of the coating apparatus 10 in opposing directions to a closed position. FIG. 3 shows the respective portions 10*a*, 10*b* of the coating apparatus 10 retracted to an open position. Advantageously, the respective portions 10*a*, 10*b* of the coating apparatus 10 in FIGS. 1–3 move in opposing directions along a longitudinal axis 54. However, the respective portions 10*a*, 10*b* of coating apparatus 10 could be moved from an open position to a closed position along a path different from the longitudinal axis 54. For instance, one or both the respective portions 10*a*, 10*b* of coating apparatus 10 could move along an arcuate path to achieve a closed or open position.

Coating apparatus 10 further includes a guide member 56. Although guide member 56 can be mounted to any suitable structure, advantageously, the guide member is mounted to support structure 50. More advantageously, guide member 56 is connected to base member 50 and is adapted to align and support the elongated cable 18 during the coating process. Guide member 56 has a V-shaped support block 58 mounted atop a support rod 60.

Figure 4:
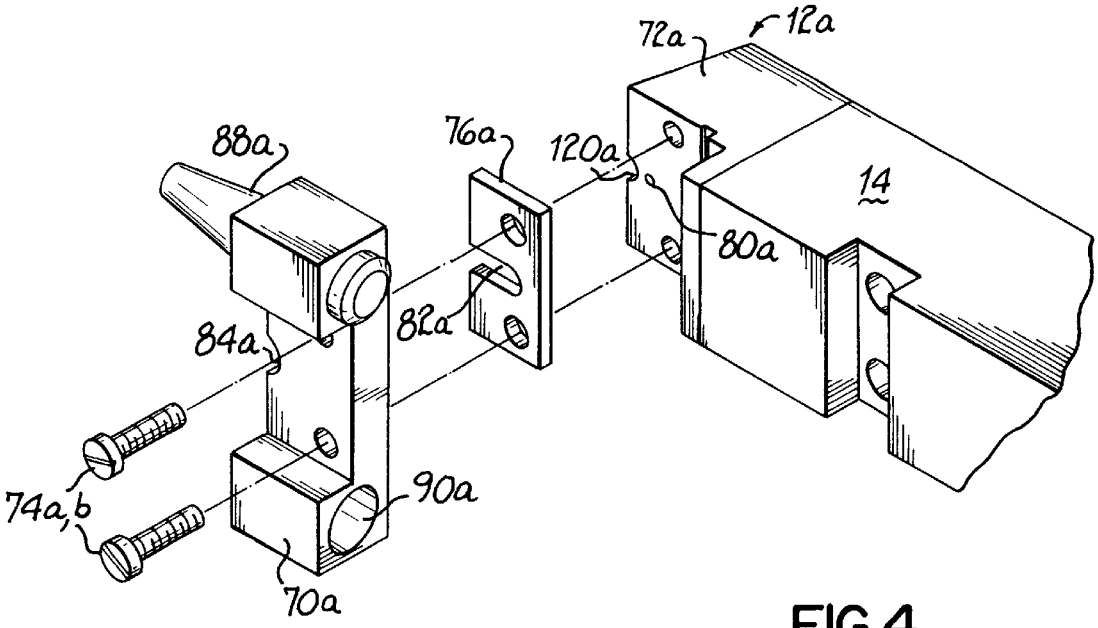
FIG. 4 is a disassembled perspective view of a dispensing module and coating head portion from FIGS. 1 and 2.

With reference to FIGS. 3 and 4, the coating apparatus 10 is shown in an open position. For the following discussion of the coating head 12, a detailed description of only first portion 12*a* will be presented as each portion 12*a*, 12*b* of coating head 12 contains the same components and operates in the same manner. As such, any component of first portion 12*a* will be labelled with an "a" suffix which will correspond to a component of second portion 12*b* labelled with a "b" suffix. First portion 12*a* includes a first mouthpiece 70*a* which is mounted to a first liquid discharge piece 72*a* with screws 74*a*. First shim 76*a* is disposed between first mouthpiece 70*a* and first liquid discharge piece 72*a*. Liquid discharge piece 72*a* is mounted to one end of first dispensing module 14 with screws 78*a* (FIG. 3). Liquid discharge piece 72*a* has a liquid discharge orifice 80*a* which is in fluid communication with the liquid passageways in first dispensing module 14. Liquid discharge piece 72*a* may also include a valve seat 73*a* (FIG. 7) which is adapted to receive a valve stem 75*a* projecting from dispensing module 14 for controlling the flow of the liquid. First shim 76*a* is shaped so as to form a liquid discharge channel 82*a* between first mouthpiece 70*a* and first liquid discharge piece 72*a*. Liquid discharge channel 82*a* is in fluid communication with liquid discharge orifice 80*a*.

First and second mouthpieces 70*a*, 70*b* include recesses 84*a*, 84*b* such that when first and second dispensing modules 14, 16 are in the closed position, the recesses form a throughhole 86' (FIGS. 1 and 7) for receiving the elongated cable 18. Advantageously, recesses 84*a*, 84*b* include arcuate portions for generally conforming to the elongated cable 18. For instance, if a wire substrate having a circular cross section is used, the recesses 84*a*, 84*b* will be semicircular such that when the mouthpieces 70*a*, 70*b* are in a closed position they form a circular throughhole 86'.

With further reference to FIGS. 1, 2 and 3, first and second mouthpieces 70*a*, 70*b* further include first and second alignment pins 88*a*, 88*b* and first and second alignment openings 90*a*, 90*b*. When the mouthpieces 70*a*, 70*b* are in the closed position, the first alignment pin 88*a* of first mouthpiece 70*a* engages opening 90*b* of second mouthpiece 70*b*. Likewise, second alignment pin 88*b* of second mouthpiece 70*b* engages opening 90*a* of first mouthpiece 70*a*. Alignment pins 88*a*, 88*b* and alignment openings 90*a*, 90*b* ensure proper alignment of recesses 84*a*, 84*b* so that a uniform and concentric coating may be applied to the elongated cable 18 in a repeatable manner.

First and second air actuators 34, 36 include first and second air cylinders 100*a*, 100*b* secured to stationary mounting blocks 102*a*, 102*b*. The air cylinders 100*a*, 100*b* have first and second air extension inputs 104*a*, 104*b* and first and second air retraction inputs 106*a*, 106*b*. Air inputs 104*a*, 104*b*, 106*a*, 106*b* are operatively connected to actuator control device 108, preferably using flexible plastic tubing (not shown). Air cylinders 100*a*, 100*b* include first and second air pistons 110*a*, 110*b* which can retract or extend in and out of the respective air cylinders. For example, to retract the air pistons 110*a*, 110*b*, i.e., move the mouthpieces 70*a*, 70*b* from a closed position to an open position, actuator control device 108 supplies air to air retraction inputs 106*a*, 106*b* and removes air through air extension inputs 104*a*, 104*b*. The process is reversed to move the mouthpieces 70*a*, 70*b* from an open position to a closed position.

Advantageously, actuator control device 108 is a 4-way solenoid-operated air valve to respectively control first and second air actuators 34, 36. More specifically, the 4-way solenoid valve, upon receiving an electrical signal, such as a voltage, or upon receiving no electrical signal, retracts or extends air actuators 34, 36. Although manipulation of the actuator control device 108 can be carried out in several ways to retract or extend the air pistons 110*a*, 110*b*, it is contemplated that when no voltage is applied to the air control dispensing module the air pistons will assume an open position. Consequently, to achieve a closed position of mouthpieces 70*a*, 70*b*, a 24 volt signal is applied to the air control dispensing module such that air pressure between about 25–35 psi will be applied through air extension inputs 104*a*, 104*b* to extend the air pistons 110*a*, 110*b*. As long as it is desired to keep mouthpieces 70*a*, 70*b* in a closed position, air pressure is applied to air pistons 110*a*, 110*b*. To stabilize the air pistons 110*a*, 110*b* during their operation, air actuators 34, 36 also include guide rods 112*a*, 112*b* which freely slide through mounting blocks 102*a*, 102*b* and attach respectively to first and second connecting members 42, 44. To protect the mouthpieces 70*a*, 70*b* from damage which may occur if the air pistons 110*a*, 110*b* over extend toward the closed position, bumper stops 114*a*, 114*b* are placed over guide rods 112*a*, 112*b* to limit the motion of the air pistons and thus protect mouthpieces 70*a*, 70*b*. Preferably, the bumper stops are collars with set screws 116 which allow for ready adjustment of the extension of air pistons 110*a*, 110*b* when different sized mouthpieces 70*a*, 70*b* are used.

Figure 5:
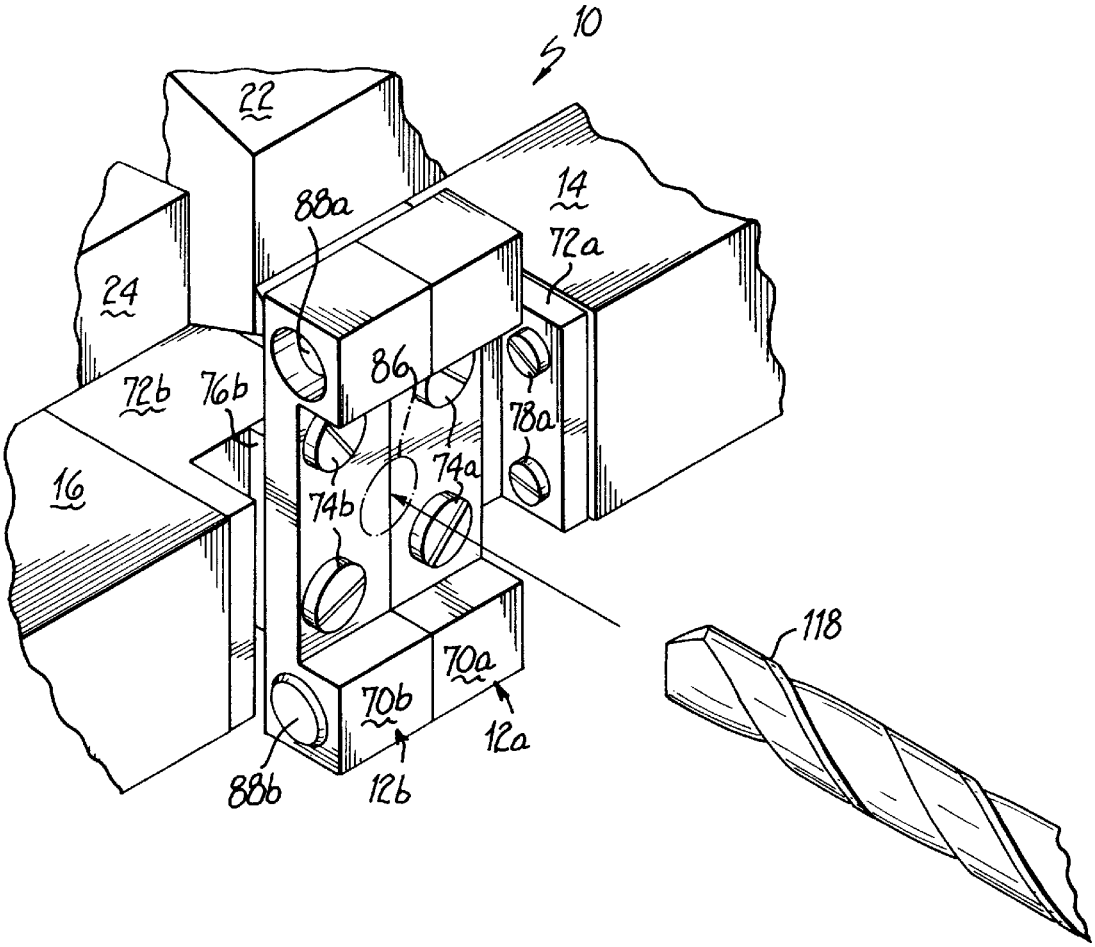
FIG. 5 is a perspective view of the coating head and dispensing modules prior to drilling of an initial throughhole in the mouthpieces.
Figure 6:
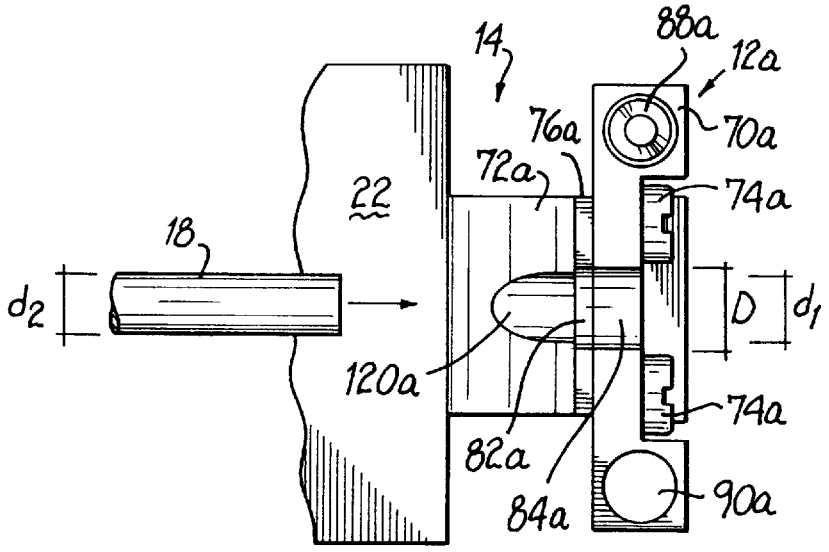
FIG. 6 is an enlarged end view of the coating dispenser taken along line 6—6 of FIG. 3.

FIGS. 5 and 6 illustrate how throughhole 86' can be machined through mouthpieces 70*a*, 70*b*. A drill bit 118 drills through mouthpieces 70*a*, 70*b* and through liquid discharge pieces 72*a*, 72*b* forming an initial throughhole 86 and arcuate recesses 120*a*, 120*b*. The initial throughhole 86 and the arcuate recesses 120*a*, 120*b* of liquid discharge pieces 72*a*, 72*b* have a diameter d1 in the closed position closely approximating the diameter d2 (FIG. 6) of the elongated cable 18. To achieve the desired coating thickness, the mouthpieces 70*a*, 70*b* are removed from their respective liquid discharge pieces 72*a*, 72*b*, clamped together, and then drilled with another drill bit (not shown) having a larger diameter D which corresponds to the final throughhole 86'. As such, the diameter of initial throughhole 86 has been expanded from diameter d1 to diameter D such that the diameter of the final throughhole 86' is greater than the diameter of the arcuate recesses 120*a*, 120*b* (FIG. 2) of liquid discharge pieces 72*a*, 72*b*. That is, final throughhole 86' and arcuate recesses 120*a*, 120*b* form a stepped bore in the closed position. Accordingly, the coating thickness is determined by subtracting diameter d2 from diameter D.

Because the drilling operations are specific to a particular size of wire or cable and a particular coating thickness, if a different sized substrate or coating thickness is desired, a blank set of mouthpieces 70*a*, 70*b* and liquid discharge pieces 72*a*, 72*b* are drilled to accommodate the new sizes. Accordingly, it is contemplated that the combination of the dispensing modules 14, 16 and their respective coating dispensers portions 12*a*, 12*b* will be manufactured and used as a matched pair. Although different-sized coating dispenser portions 12*a*, 12*b* could alone be substituted to accommodate different-sized wire or coating thickness, the removal of the coating dispenser portions 12*a*, 12*b* from their respective dispensing modules 14, 16 may expose the valve stem, valve seat and other internal parts of the dispensing modules to possible damage and undesirable contamination. Consequently, it is presently contemplated that if a different substrate size or coating thickness is desired, a new matched set of dispensing modules 14, 16 and respective coating dispensers portions 12*a*, 12*b* will be employed instead of merely substituting new coating dispenser portions 12*a*, 12*b*.

Figure 7:
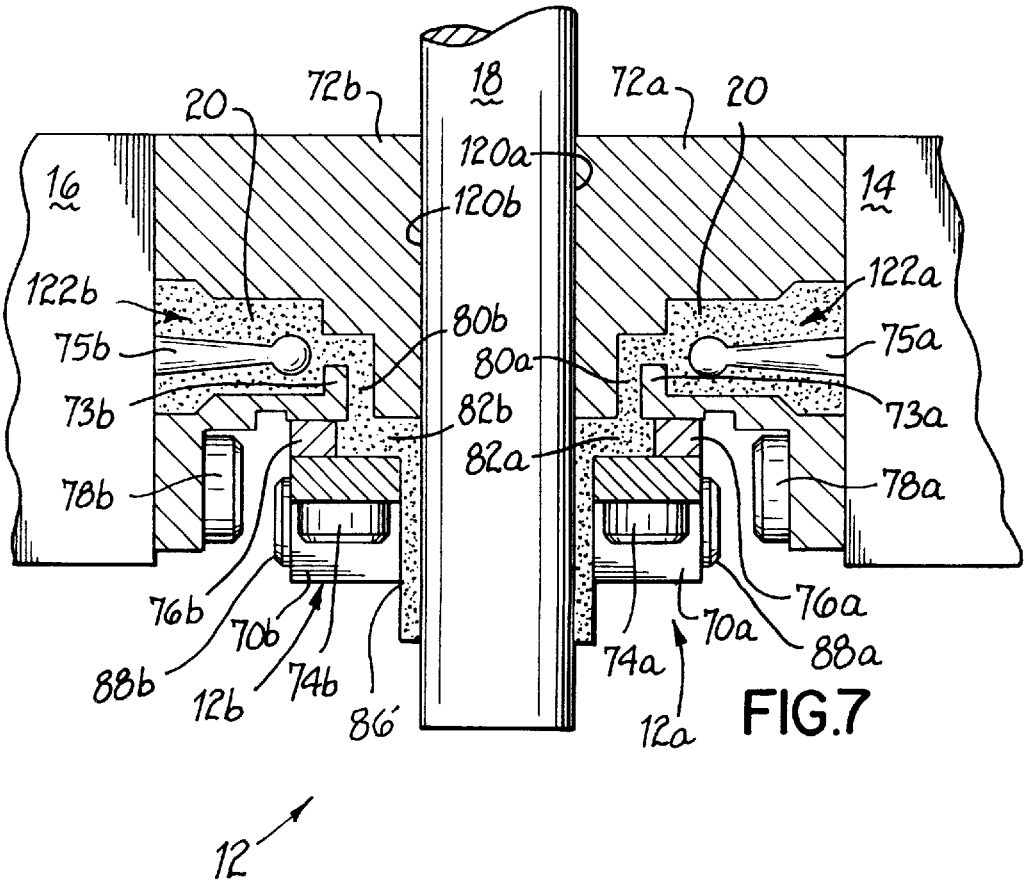
FIG. 7 is an enlarged partial cross-sectional view of the coating apparatus of FIG. 1 taken along line 7—7 showing the flow passages of the coating dispenser.

Referring to FIGS. 2 and 7, a coating method in accordance with the invention comprises the steps of placing the first and second mouthpieces 70*a*, 70*b* in opposing, closed positions about cable 18 so that cable 18 extends through throughhole 86' formed by the recesses 84*a*, 84*b*. The mouthpieces 70*a*, 70*b* are moved from their open position (FIG. 3) to their closed position (FIGS. 1 and 2) by means of actuators 34, 36. More specifically, an appropriate command signal, for example a voltage, is applied to actuator control device 108 which supplies pressurized air to air extension inputs 104*a*, 104*b*. Accordingly, air pistons 110*a*, 110*b* extend from air cylinders 100*a*, 100*b* moving dispensing modules 14, 16 and mouthpieces 70*a*, 70*b* to the closed position to form throughhole 86'. As the mouthpieces 70*a*, 70*b* are moved together, they are aligned by pins 88*a*, 88*b*. The elongated cable 18 is then moved linearly through the throughhole 86'. At the same time, liquid 20 is discharged from the dispensing modules 14, 16 into the throughhole 86' via liquid discharge channel 82. The liquid 20 flows from dispensing modules 14, 16 and into internal passages 122*a*, 122*b* of liquid discharge pieces 72*a*, 72*b*. The liquid then exits liquid discharge orifices 80*a*, 80*b* into liquid discharge channel 82*a*, 82*b*. The liquid flows out of liquid discharge channels 82*a*, 82*b* in the form of a flat ribbon of liquid until it makes contact with the cable 18 at which time it adheres to the exterior of the substrate to form the desired coating.

Figure 8:
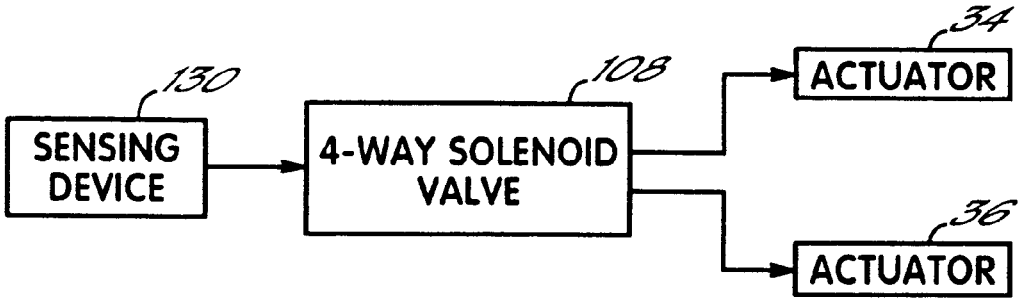
FIG. 8 is a block diagram representing a basic control system for the coating apparatus of FIG. 1.

Referring now to FIGS. 1 and 8, the present invention also enables mouthpieces 70*a*, 70*b* to automatically retract from the substrate 18 when the substrate production line stops, e.g., when the substrate stops moving and/or the coating is no longer being applied to the substrate. This automatic retraction feature is especially beneficial for temperature-sensitive substrates, such as fiber optic cable, that may be damaged by extended contact with the heated mouthpieces 70*a*, 70*b*. To that end, a sensing device 130, such as a conventional motion sensor, monitors the motion of substrate 18. Sensing device 130 is operatively coupled to solenoid valve 108 which controls air input to air actuators 34, 36. If, during production of a substrate, sensing device 130 detects that substrate 18 has stopped moving, the sensing device directly or indirectly signals actuator control device 108 to cause actuators 34, 36 to retract mouthpieces 70*a*, 70*b* away from the substrate. Preferably, this retraction occurs immediately, however, it may occur after a tolerable delay. At the same time, a suitable control may stop the dispensing of coating liquid, as necessary. Those of ordinary skill will appreciate that many other methods of implementing such a control system are within the scope of these inventive concepts.

While the present invention has been illustrated by a description of various preferred embodiments and while these embodiments have been described in considerable detail in order to describe the best mode of practicing the invention, it is not the intention of applicants to restrict or in any way limit the scope of the appended claims to such detail. Additional advantages and modifications within the spirit and scope of the invention will readily appear to those skilled in the art. The invention itself should only be defined by the appended claims, wherein,

We claim:

1. An apparatus for use in a coating operation of an elongated substrate, the apparatus comprising:

first and second dispensers mounted generally adjacent each other, each dispenser having a liquid passageway adapted to connect to a source of coating liquid for dispensing the coating liquid;

an actuator operatively connected to said first dispenser for moving said first dispenser toward and away from said second dispenser between respective open and closed positions;

a second actuator connected to said second dispenser for moving said second dispenser between said open and closed positions;

first and second coating head portions having mouthpieces connected respectively with said first and second dispensers, the mouthpieces having complimentary recesses such that when said first and second dispensers are in said closed position said recesses form a throughhole for receiving the elongated substrate, each recess communicating with said liquid passageway in each respective dispenser such that when said first and second dispensers are in said closed position the elongated substrate moving through said throughhole may be coated with the coating liquid;

at least one actuator control device connected with said actuators and controlling the operation of said actuators; and a sensing device for detecting when the coating operation has stopped and, in response, causing the actuator control device to activate the actuators to move said first and second dispensers to said open position.

2. The apparatus of claim 1 further comprising:

a guide member mounted to align and support the elongated substrate as the elongated substrate passes through said throughhole.

3. The apparatus of claim 1 wherein said recesses in said first and second mouthpieces include respective arcuate portions for generally conforming to the elongated substrate.

4. The apparatus of claim 1 wherein said first and second dispensers are disposed opposite one another along a straight axis and said first dispenser moves along the straight axis.

5. The apparatus of claim 1 wherein said throughhole further includes a stepped bore having a first portion with a first diameter corresponding to a diameter of the elongated substrate and a second portion having a second diameter corresponding to a total diameter of the substrate combined with the coating liquid after placement thereon, whereby the coating liquid is directed into the second portion to coat the elongated substrate.

6. The apparatus of claim 1 wherein each mouthpiece includes an alignment member and an alignment opening such that when said first and second dispensers are in said closed position said alignment member of said first mouthpiece is disposed within said alignment opening of said second mouthpiece and said alignment member of said second mouthpiece is disposed within said alignment opening of said first mouthpiece.

7. An apparatus for use in a coating operation of an elongated substrate, the apparatus comprising:

first and second dispensers mounted generally adjacent each other, each dispenser having a liquid passageway adapted to connect to a source of coating liquid for dispensing the coating liquid;

an actuator operatively connected to said first dispenser for moving said first dispenser toward and away from said second dispenser between respective open and closed positions;

first and second coating heads having mouthpieces connected respectively with said first and second dispensers, the mouthpieces having complimentary recesses such that when said first and second dispensers are in said closed position said recesses form a throughhole for receiving the elongated substrate, each recess communicating with said liquid passageway in each respective dispenser such that when said first and second dispensers are in said closed position the elongated substrate moving through said throughhole may be coated with the coating liquid;

first and second liquid discharge pieces operatively connected respectively between said first and second dispensers and said first and second mouthpieces, the liquid discharge pieces having respective liquid discharge orifices in fluid communication with the respective liquid passageways of said first and second dispensers; and first and second shims operatively connected respectively between said first and second liquid discharge pieces and said first and second mouthpieces to form a liquid discharge channel in fluid communication with said liquid discharge orifice.

8. An apparatus for coating an elongated substrate during a coating operation, comprising:

first and second dispensing valves, each dispensing valve having a liquid passageway adapted to connect to a source of coating liquid, said first and second dispensing valves being disposed in opposed positions;

first and second actuators operatively connected to said first and second dispensing valves for moving said first and second dispensing valves in opposing directions between open and closed positions; and first and second mouthpieces connected respectively with said first and second dispensing valves, the mouthpieces having complimentary arcuate recesses such that when said first and second actuators move said first and second dispensing valves and said first and second mouthpieces as respective units from said open position in which said arcuate recesses are spaced to said closed position in which said arcuate recesses form a throughhole for receiving the elongated substrate, each recess communicates with said liquid passageway in each respective dispensing valve such that the elongated substrate passing through said throughhole may be coated with the coating liquid.

9. The apparatus of claim 8 wherein said throughhole further includes a stepped bore having a first portion with a first diameter corresponding to a diameter of the substrate and a second portion having a second diameter corresponding to a total diameter of the substrate combined with the coating liquid after placement thereon, whereby the coating liquid is directed into the second portion to coat the elongated substrate.

10. The apparatus of claim 9 further comprising:

at least one actuator control device connected with said actuators and controlling the operation of said actuators; and a sensing device for detecting when the coating operation has stopped and, in response, causing the actuator control device to activate the actuators to move said first and second dispensing valves to the open position.

* * * * *